US010265601B1

(12) United States Patent
Baker

(10) Patent No.: US 10,265,601 B1
(45) Date of Patent: Apr. 23, 2019

(54) BATTING CAGE

(71) Applicant: Earl Jacob Baker, Southaven, MS (US)

(72) Inventor: Earl Jacob Baker, Southaven, MS (US)

( * ) Notice: Subject to any disclaimer, the term of this patent is extended or adjusted under 35 U.S.C. 154(b) by 0 days.

(21) Appl. No.: 15/805,363

(22) Filed: Nov. 7, 2017

Related U.S. Application Data

(63) Continuation-in-part of application No. 15/731,144, filed on Apr. 4, 2017, now abandoned.

(51) Int. Cl.
*A63B 71/02* (2006.01)
*A63B 69/00* (2006.01)

(52) U.S. Cl.
CPC ..... *A63B 71/022* (2013.01); *A63B 69/0002* (2013.01); *A63B 71/023* (2013.01); *A63B 2069/0008* (2013.01)

(58) Field of Classification Search
CPC ..... A63B 71/02; A63B 69/36; A63B 69/00; A63B 69/40; A63B 63/00
See application file for complete search history.

(56) References Cited

U.S. PATENT DOCUMENTS 1,566,945 A * 12/1925 Winkley ..... A63B 63/00 473/173
5,080,375 A * 1/1992 Moosavi ..... A63B 63/004 473/478
5,452,896 A * 9/1995 Core ..... A63B 71/022 273/410
5,467,990 A * 11/1995 Kitzhaber ..... A63B 69/3661 473/164
5,580,064 A * 12/1996 Childers, Jr. ..... A63B 63/004 273/400
6,165,085 A * 12/2000 Lubin ..... A63B 63/004 273/400
8,647,221 B1 * 2/2014 Hochberg ..... A63B 69/002 473/422
2015/0352426 A1 * 12/2015 Romero ..... A63B 71/022 473/421

* cited by examiner

*Primary Examiner* — Eugene L Kim
*Assistant Examiner* — Christopher A Glenn

(57) ABSTRACT

The batting cage comprises a portable backstop and a batting tee. The portable backstop may be assembled at a practice field from a plurality of frame pole sections, elbows, braces, and mesh screen covering. The frame pole sections assemble into uprights, crossbars, and sidebars that form a frame which the mesh screen covering is stretched over. The batting tee is placed in front of the portable backstop. A ball is placed on a post rising from the batting tee base and the ball is hit into the backstop by a batter. The backstop restricts the ball's travel. The height, forward position, and lateral position of the post are adjustable. An optional target on the rear wall of the portable backstop provides an aiming point for a perfectly hit ball.

9 Claims, 6 Drawing Sheets

BATTING CAGE

CROSS REFERENCES TO RELATED APPLICATIONS

This application is a continuation-in-part of U.S. application Ser. No. 15/731,144 that was filed on Apr. 4, 2017.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of athletic training aids, more specifically, a batting cage.

SUMMARY OF INVENTION

The batting cage comprises a portable backstop and a batting tee. The portable backstop may be assembled at a practice field from a plurality of frame pole sections, elbows, braces, and mesh screen covering. The frame pole sections assemble into uprights, crossbars, and sidebars that form a frame which the mesh screen covering is stretched over. The batting tee is placed in front of the portable backstop. A ball is placed on a post rising from the batting tee base and the ball is hit into the backstop by a batter. The backstop restricts the ball's travel. The height, forward position, and lateral position of the post are adjustable. An optional target on the rear wall of the portable backstop provides an aiming point for a perfectly hit ball.

An object of the invention is to provide a portable backstop for hitting practice.

Another object of the invention is to provide a backstop that may be assembled and disassembled for transportation and storage.

A further object of the invention is to provide a batting tee with use with the potable backstop.

Yet another object of the invention is to provide the batting tee with height, side to side, and front to back adjustment of the ball position.

These together with additional objects, features and advantages of the batting cage will be readily apparent to those of ordinary skill in the art upon reading the following detailed description of the presently preferred, but nonetheless illustrative, embodiments when taken in conjunction with the accompanying drawings.

In this respect, before explaining the current embodiments of the batting cage in detail, it is to be understood that the batting cage is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the batting cage.

It is therefore important that the claims be regarded as including such equivalent construction insofar as they do not depart from the spirit and scope of the batting cage. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
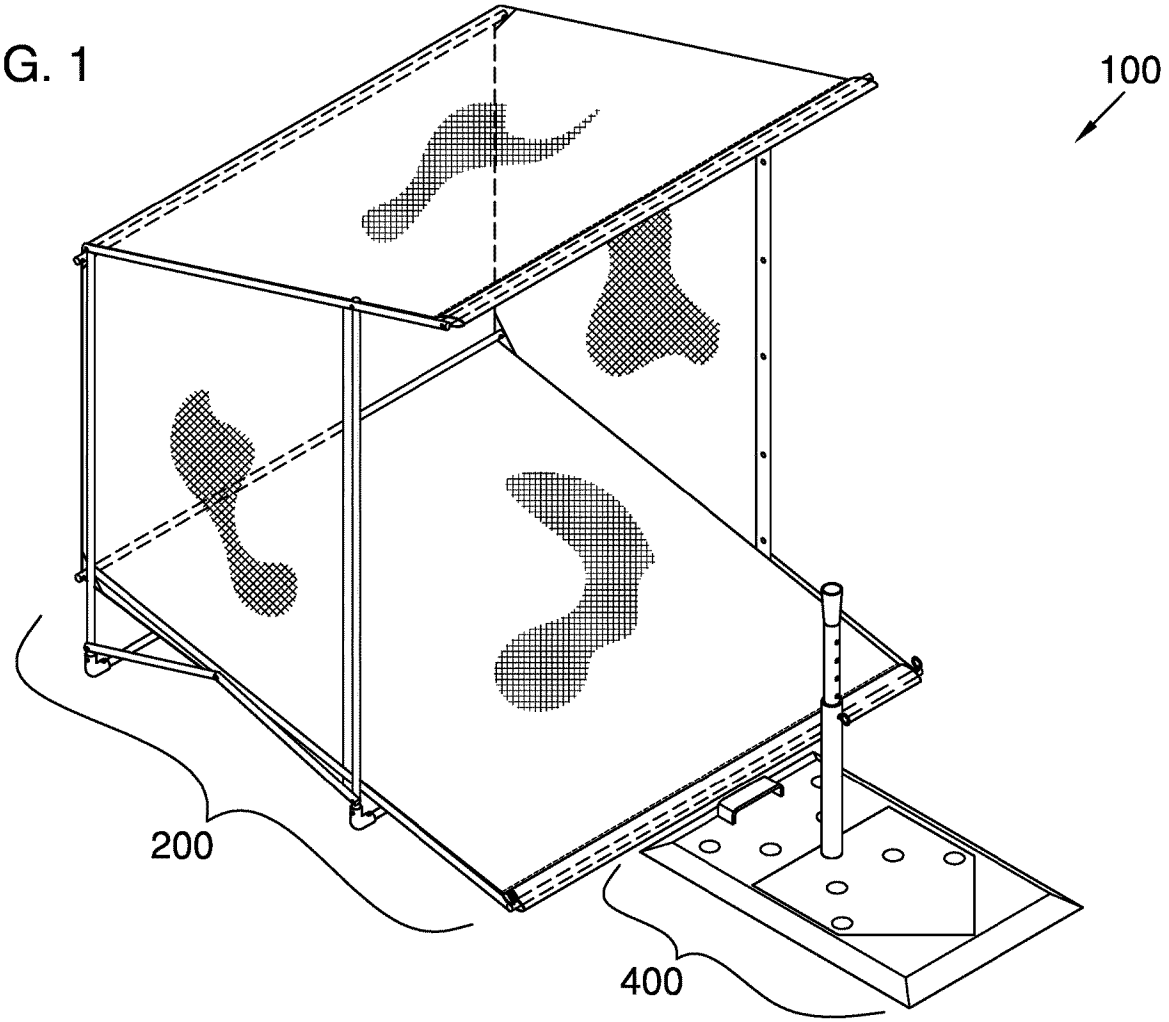
FIG. 1 is a perspective view of an embodiment of the disclosure.
Figure 2:
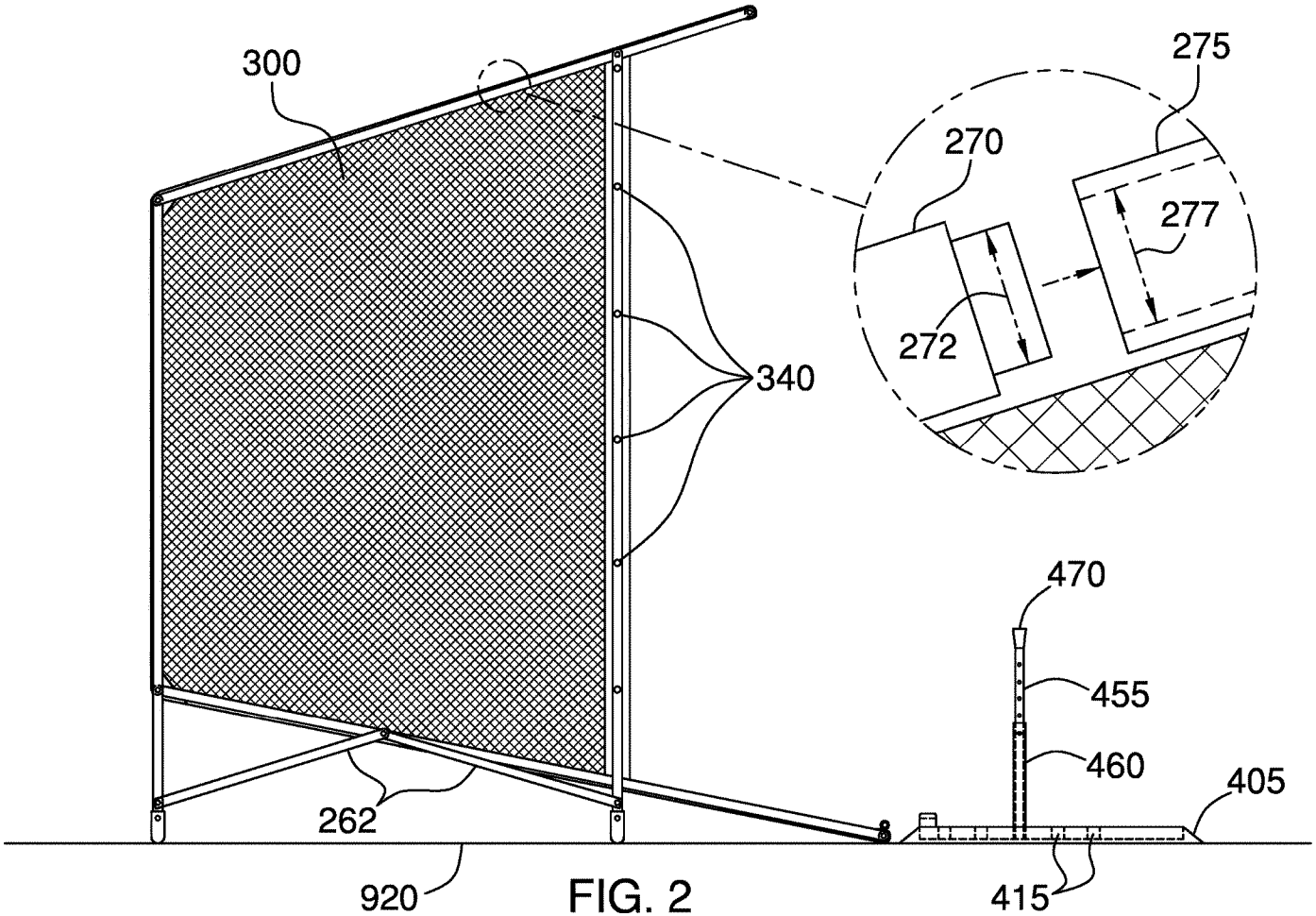
FIG. 2 is a side view of an embodiment of the disclosure.
Figure 3:
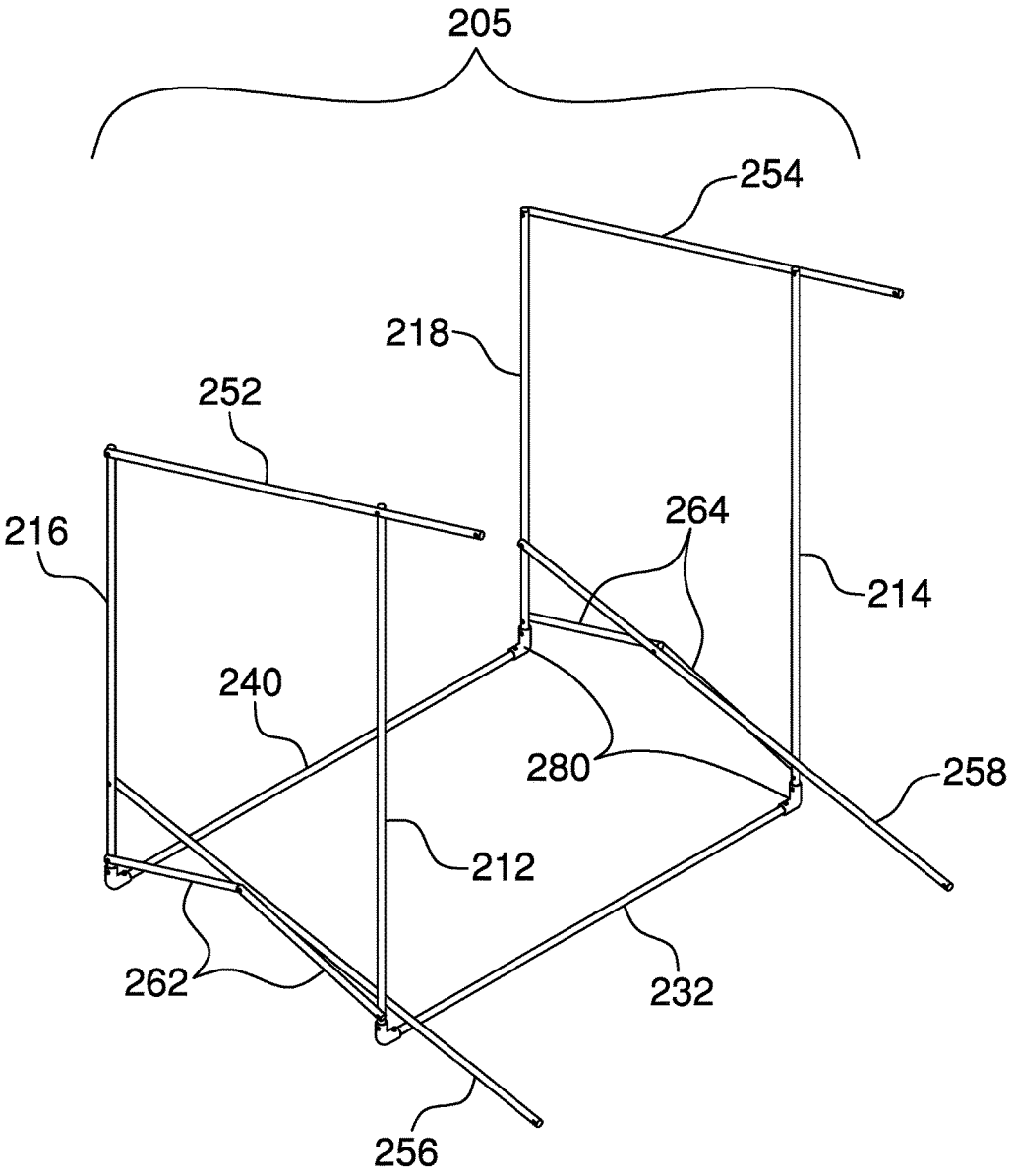
FIG. 3 is a detail view of an embodiment of the disclosure illustrating frame assembly.
Figure 4:
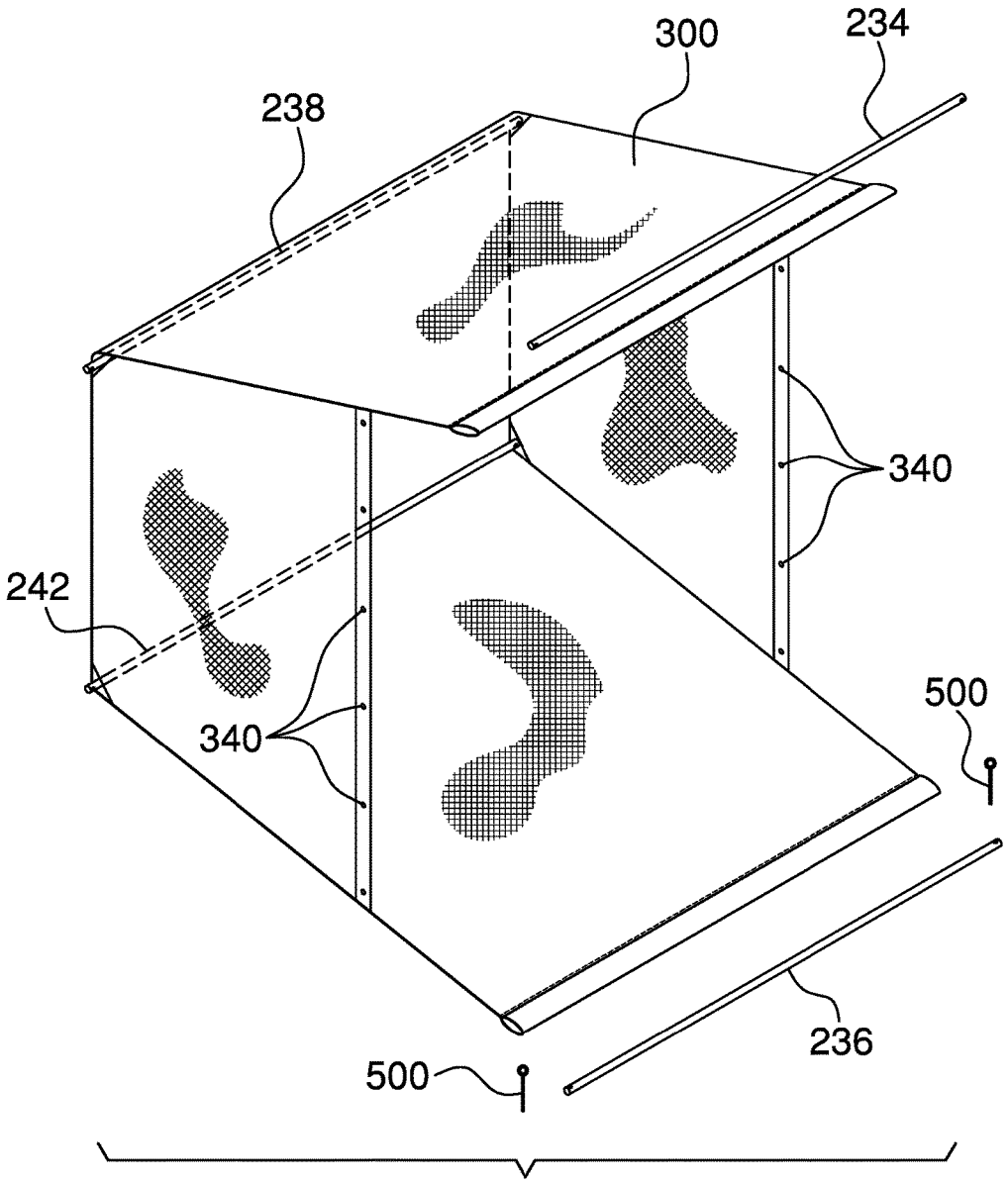
FIG. 4 is a detail view of an embodiment of the disclosure showing placement of the mesh screen covering.
Figure 5:
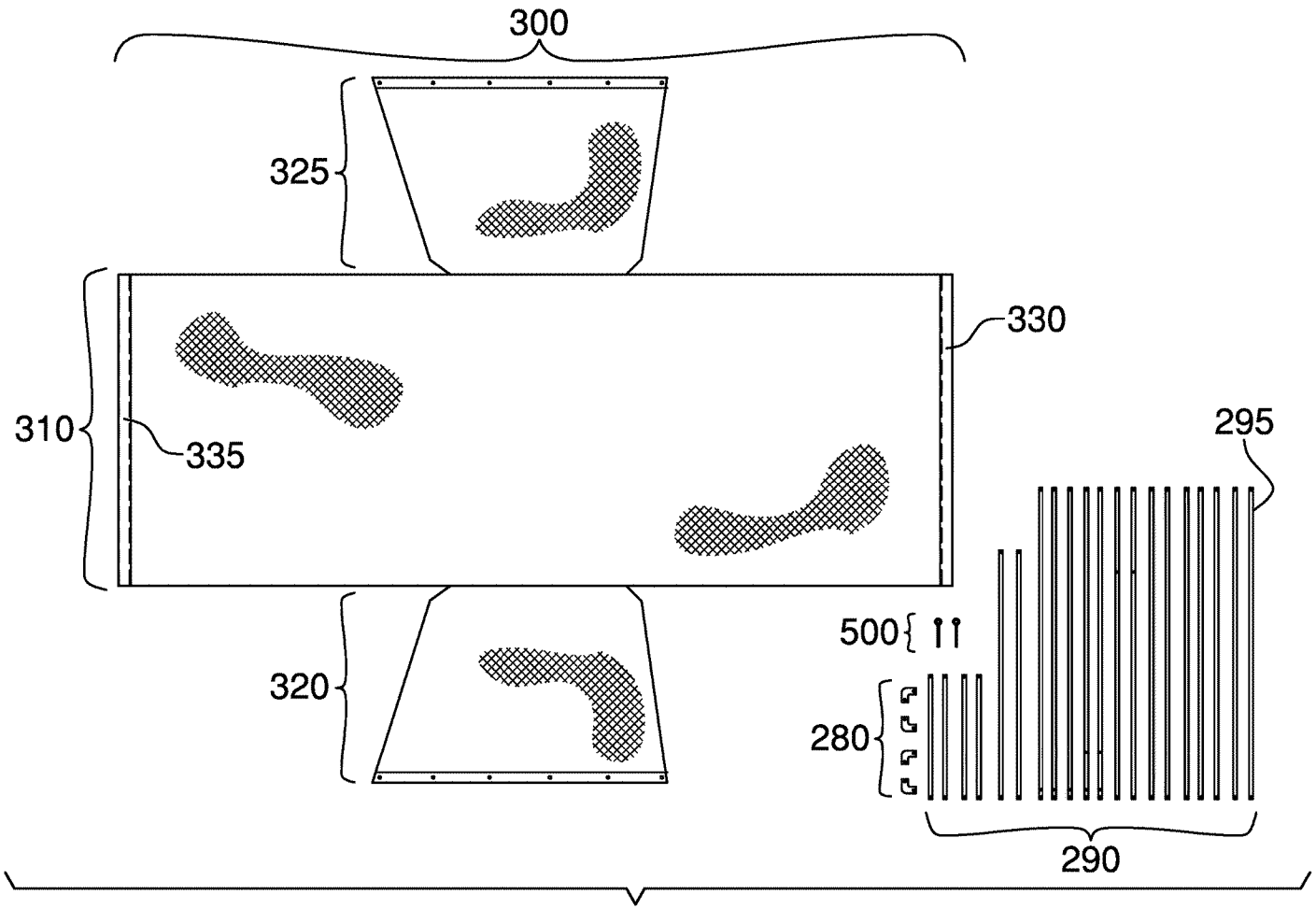
FIG. 5 is an exploded view of an embodiment of the disclosure.
Figure 6:
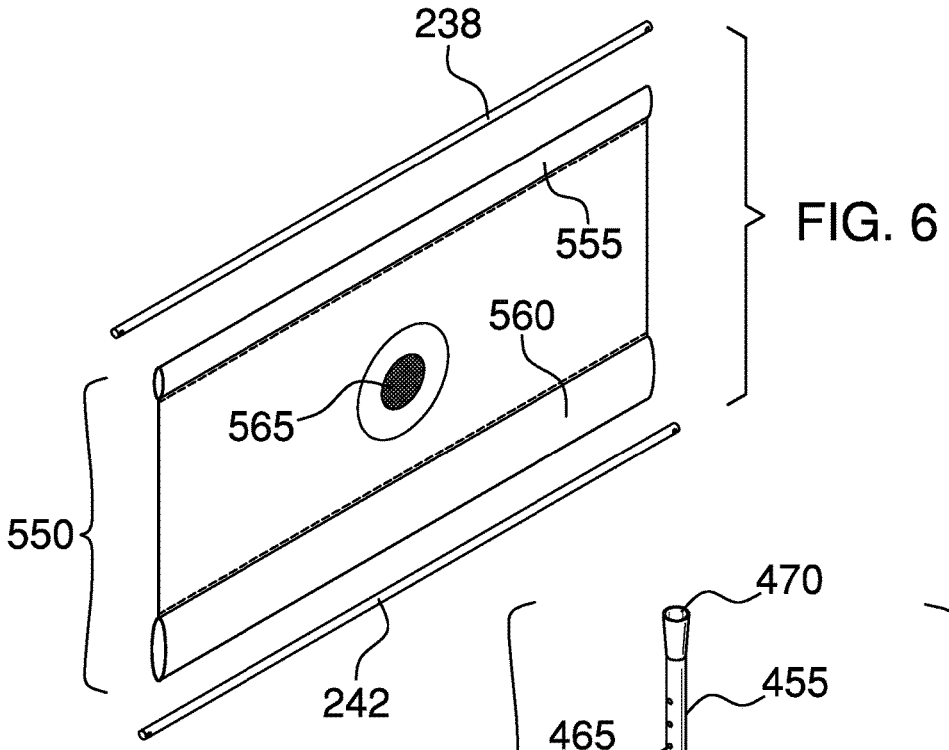
FIG. 6 is a detail view of an embodiment of the disclosure showing the target panel.
Figure 7:
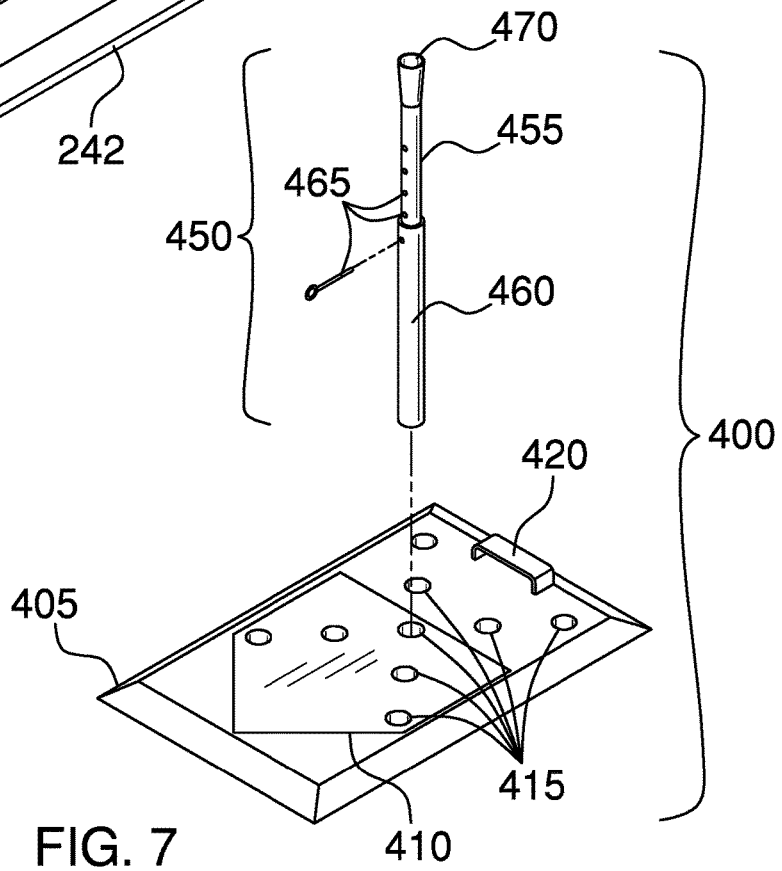
FIG. 7 is a detail view of an embodiment of the disclosure showing the batting tee.

Detailed reference will now be made to a first potential embodiment of the disclosure, which is illustrated in FIGS. 1 through 7.

The batting cage 100 (hereinafter invention) comprises a portable backstop 200 and a batting tee 400. The portable backstop 200 can be assembled at a practice location. The batting tee 400 may be set in front of the portable backstop 200 and a batter (not illustrated in the figures) may practice hitting a ball (not illustrated in the figures) from the top of a post 450 on the batting tee 400 into the portable backstop 200.

The portable backstop 200 comprises a framework 205 and a mesh screen covering 300. The framework 205 may provide a rigid support structure to hold the mesh screen covering 300 in place. The mesh screen covering 300 may provide a barrier to retain the ball within the portable backstop 200 after the ball is hit by the batter. The portable backstop 200 may have a front side, which is the open side of the portable backstop 200. The portable backstop 200 may have a rear side, which is the side opposite the front side. The portable backstop 200 may have a left side and a right side which are the left and right side of the portable backstop 200 when viewed by the batter while the batter is standing in front of the portable backstop 200 and facing the portable backstop 200. The portable backstop 200 may have a bottom side, which is the side of the portable backstop 200 that is closes to the ground 920. The portable backstop 200 may have a top side, which is the side opposite the bottom side.

The framework 205 comprises a plurality of uprights, a plurality of crossbars, a plurality of sidebars, a plurality of elbows 280, and a plurality of braces. The plurality of uprights, the plurality of crossbars, and the plurality of sidebars may be assembled from a plurality of frame pole sections 290. An individual frame pole section 295 selected from the plurality of frame pole sections 290 may be a round metal tube between 1 ft and 6 ft in length. The lengths of the plurality of frame pole sections 290 may vary based upon where on the portable backstop 200 they are used.

The plurality of frame pole sections 290 may interconnect with each other or may connect to one or more of the plurality of elbows 280. The interconnections between the plurality of frame pole sections 290 or between the plurality of frame pole sections 290 and the plurality of elbows 280 may consist of the insertion of a first frame pole 270 having an outside diameter 272 into a second frame pole 275 having an inside diameter 277, where the outside diameter 272 of the first frame pole 270 is smaller than the inside diameter 277 of the second frame pole 275.

In some embodiments, the plurality of frame pole sections 290 may interconnect with each other and with the plurality of braces using permanently hinged joints, pin through hole retainers, and other connection hardware.

An upper left sidebar 252, an upper right sidebar 254, an upper front mesh retention crossbar 234, and an upper rear mesh retention crossbar 238 may form a rectangular upper frame that supports the mesh screen covering 300 over the top of the portable backstop 200. The rectangular upper frame may be inclined so as to be higher in the front and lower in the rear.

A lower left sidebar 256, a lower right sidebar 258, a lower front mesh retention crossbar 236 and a lower rear mesh retention crossbar 242 may form a rectangular lower frame that supports the mesh screen covering 300 over the bottom of the portable backstop 200. The rectangular lower frame may be inclined so as to be lower in the front and higher in the rear. The front of the rectangular lower frame may touch the ground 920. The inclination of the rectangular lower frame may causes the balls to roll back towards the batter after they are stopped by the portable backstop 200.

A front left upright 212, a rear left upright 216, the lower left sidebar 256, and the upper left sidebar 252 may form a left side frame that supports the mesh screen covering 300 on the left side of the portable backstop 200. A left side frame may be trapezoidal shaped due to the inclinations of the rectangular upper frame and the rectangular lower frame, which narrow the portable backstop 200 on the rear side.

A front right upright 214, a rear right upright 218, the lower right sidebar 258, and the upper right sidebar 254 may form the right side frame that supports the mesh screen covering 300 on the right side of the portable backstop 200. The right side frame may be trapezoidal shaped due to the inclinations of the rectangular upper frame and the rectangular lower frame, which narrow the portable backstop 200 on the rear side.

The front left upright 212 and the front right upright 214 may extend below the plane of the rectangular lower frame and both may couple to a front lower crossbar 232 via two of the plurality of elbows 280. The front lower crossbar 232 may rest on the ground 920.

The rear left upright 216 and the rear right upright 218 may extend below the plane of the rectangular lower frame and both may couple to a lower rear crossbar 240 via two of the plurality of elbows 280. The lower rear crossbar 240 may rest on the ground 920.

The plurality of braces may comprise one or more left side braces 262 and one or more right side braces 264. The one or more left side braces 262 may couple from the lower left sidebar 256 to the rear left upright 216 and to the front left upright 212 to stabilize the left side frame. The one or more right side braces 264 may couple from the lower right sidebar 258 to the rear right upright 218 and to the front right upright 214 to stabilize the right side frame.

The mesh screen covering 300 comprises a rectangular mesh panel 310, a left mesh wing 320, and a right mesh wing 325. The rectangular mesh panel 310 may couple to the lower front mesh retention crossbar 236 by sliding the lower front mesh retention crossbar 236 through a lower crossbar sleeve 330. The rectangular mesh panel 310 may then pass under the lower rear mesh retention crossbar 242, up and over the upper rear mesh retention crossbar 238, and then couple to the upper front mesh retention crossbar 234 by sliding the upper front mesh retention crossbar 234 into an upper crossbar sleeve 335.

The left mesh wing 320 may be a trapezoidal shaped mesh panel that couples to the rectangular mesh panel 310 at the center of the left edge of the rectangular mesh panel 310. Specifically, the shorter parallel edge of the left mesh wing 320 may be sewn to the left edge of the rectangular mesh panel 310. The right mesh wing 325 may be a trapezoidal shaped mesh panel that couples to the rectangular mesh panel 310 at the center of the right edge of the rectangular mesh panel 310. Specifically, the shorter parallel edge of the right mesh wing 325 may be sewn to the right edge of the rectangular mesh panel 310. The left mesh wing 320 and the right mesh wing 325 are positioned on the rectangular mesh panel 310 such that when the rectangular mesh panel 310 is installed onto the lower front mesh retention crossbar 236, the lower rear mesh retention crossbar 242, the upper rear mesh retention crossbar 238, and the upper front mesh retention crossbar 234 as previously described, the left mesh wing 320 and the right mesh wing 325 align with the left side frame and the right side frame formed by the framework 205, respectively.

A plurality of fasteners 340 may be distributed on the front edge of the left mesh wing 320, the front edge of the right mesh wing 325, the front left upright 212, and the front right upright 214. The plurality of fasteners 340 may allow the left mesh wing 320 to couple to the front left upright 212 and may allow the right mesh wing 325 to couple to the front right upright 214.

In some embodiments, the plurality of fasteners 340 may be snap fasteners.

The batting tee 400 comprises a base 405 and the post 450. The base 405 may be a flat, rectangular mat. As a non-limiting example, the base 405 may be fabricated from rubber or plastic. The base 405 may comprise a home plate marking 410 showing on the top surface of the base 405. As a non-limiting example, the home plate marking 410 may be embossed, may be a different coloration, or may be a combination thereof. The home plate marking 410 may be used to train the batter positioning and foot placement for batting.

The batting tee 400 may comprise a plurality of post holes 415. Each of the plurality of post holes 415 represents a location where the post 450 may be placed on the base 405. One of the plurality of post holes 415 may be located at the center of the base 405 and placing the post 450 in that hole may allow the batter to practice hitting perfectly thrown pitches. Others of the plurality of post holes 415 may be located to the left or right of center and placing the post 450 in those holes may allow the batter to practice hitting inside pitches and outside pitches. Still others of the plurality of post holes 415 may be placed in front of the center and behind the center of the base 405 and placing the post 450 in these holes may allow the batter to practice hitting other types of pitches, early swings, and late swings.

In some embodiments, the base 405 may comprise a carrying handle 420.

The post 450 may be an adjustable stanchion that holds the ball at a specific height so that the batter may hit the ball with a bat (not illustrated in the figures). The post 450 may comprise an upper post 455, a lower post 460, a height adjustment 465, and a ball cup 470. The upper post 455 and the lower post 460 may be hollow tubes of different diameters. The outside diameter of the upper post 455 may be smaller than the inside diameter of the lower post 460. The position of the upper post 455 relative to the lower post 460 may be maintained by the height adjustment 465. The height adjustment 465 may be released to adjust the overall height of the batting tee 400. The bottom end of the lower post 460 may be the same diameter as the plurality of post holes 415 in the base 405 so that the post 450 may be placed into the base 405. The post 450 may be adjusted to place the ball vertically at the center of the strike zone to allow the batter to practice hitting perfectly thrown pitches. The post 450 may be adjusted up or down from the center of the strike zone to practice hitting other types of pitches. The ball cup 470 may be a horizontally oriented concave surface that prevents the ball from rolling out of the post 450 until the ball is hit.

One or more anchor pins 500 may be pushed into the ground 920 to hold the portable backstop 200 in place. The one or more anchor pins 500 may be pushed through the mesh screen covering 300 and/or through holes in the plurality of crossbars. Alternatively, the tops of the one or more anchor pins 500 may be hooked shaped and the tops of the one or more anchor pins 500 may wrap over the top of the plurality of crossbars.

The invention 100 may further comprise a target panel 550. The target panel 550 may comprise a rectangular fabric panel having a target panel upper sleeve 555, a target panel lower sleeve 560, and an aiming point 565 and which is hung at the rear of the portable backstop 200. The target panel 550 may be positioned within the portable backstop 200 by sliding the upper rear mesh retention crossbar 238 through the target panel upper sleeve 555 and by sliding the lower rear mesh retention crossbar 242 through the target panel lower sleeve 560 during assembly. The aiming point 565 may be a marking on the target panel 550 that represents the destination of a perfectly hit ball. As a non-limiting example, the aiming point 565 may be one or more concentric circles marked on the target panel 550.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "align" means to place two or more components into positions and orientations which either arranges the components along a straight line or within the same plane or which will allow the next step of assembly to proceed. As a non-limiting example, the next step of assembly may be to insert one component into another component.

As used in this disclosure, an "anchor" is a device that holds an object in place. When used as a verb, "anchor" means to hold an object firmly or securely.

As used in this disclosure, a "ball" refers to an object with a spherical or nearly spherical shape.

As used in this disclosure, a "cage" is an openwork structure that defines an interior volume. The purpose of the cage may be to contain, or at least partially contain, an object's movement.

As used in this disclosure, "concave" is used to describe a surface that resembles the interior surface of a sphere or a portion thereof.

As used herein, the words "couple", "couples", "coupled" or "coupling", mean connected, either directly or indirectly and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "front" means 1) the side of an object that is closest to a forward direction of travel under normal use of the object or 2) the side or part of an object that normally presents itself to view or that is normally used first. "Rear" or "back" is the side opposite the front.

As used herein, the term "height adjustment" refers to a mechanism that allows the overall height of an armature or stanchion to change by releasing a locking mechanism, sliding a first armature into or out of a second armature, and re-engaging the locking mechanism. As a non-limiting example, the locking mechanism may comprise a plurality of holes in the first armature and a plurality of holes in the second armature with a pin passing through the holes when they are in alignment. As a further non-limiting example, the locating mechanism may comprise a spring loaded button on an inside armature that pops through one of a plurality of holes in an outside armature and which can be pressed into the hole to release the locking mechanism. If the height adjustment comprises more than two armatures it may be known as a telescoping height adjustment.

As used herein, "home plate" refers to one of four bases used in the games of baseball, softball, or T-ball. Home plate is generally a five-sided slab set at ground level where the batter stands to receive pitches. Home plate is the final base that runners must reach in order to score a point.

As used in this disclosure, the term "mesh" refers to an openwork fabric made from threads, yarns, cords, wires, strands, or lines that are woven, knotted, or otherwise twisted or intertwined at regular intervals. A mesh may also be referred to as a net.

As used herein, the words "printed" or "marked" are intended to mean that a mark has been made on an object. The process of making the mark may involve printing, lithography, thermal transfer, painting, burning, drawing, stamping, spraying of pigments, or other processes which result in the controlled change of coloration of a surface.

As used in this disclosure, "rigid" refers to a structure that has three dimensional stability but that resists a decrease in internal volume when subjected to an external force. A rigid structure will behave in an elastic manner in the sense that when the external force is removed the internal volume will return to its original volume. This definition is consistent with the definition of rigid as described in the Cooperative Patent Classification system as described in section A45C. Luggage reference.

As used in this disclosure, a "sleeve" is a tube like covering that is placed over a rod, shaft or other cylindrical object. A sleeve is open on both ends.

As used in this disclosure, a "snap" is a fastener that comprises a male component and a female component. The snap is engaged by pressing the male component into the female component.

As used in this disclosure, a "stanchion" refers to a vertical pole, post, or support.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A batting cage comprising:

a portable backstop and a batting tee;

wherein the portable backstop can be assembled at a practice location;

wherein the batting tee is adapted to be set in front of the portable backstop and a batter practices hitting a ball from a top of a post on the batting tee into the portable backstop;

wherein the portable backstop comprises a framework and a mesh screen covering;

wherein the framework provides a rigid support structure to hold the mesh screen covering in place;

wherein the mesh screen covering provides a barrier to retain the ball within the portable backstop after the ball is hit by the batter;

wherein the framework comprises a plurality of uprights, a plurality of crossbars, a plurality of sidebars, a plurality of elbows, and a plurality of braces;

wherein the plurality of uprights, the plurality of crossbars, and the plurality of sidebars are assembled from a plurality of frame pole sections;

wherein an individual frame pole section selected from the plurality of frame pole sections is a round metal tube between 1 ft and 6 ft in length;

wherein the plurality of frame pole sections interconnect with each other or connect to one or more of the plurality of elbows;

wherein the interconnections between the plurality of frame pole sections or between the plurality of frame pole sections and the plurality of elbows consist of an insertion of a first frame pole having an outside diameter into a second frame pole having an inside diameter, where an outside diameter of the first frame pole is smaller than an inside diameter of the second frame pole;

wherein an upper left sidebar, an upper right sidebar, an upper front mesh retention crossbar, and an upper rear mesh retention crossbar comprise a rectangular upper frame that supports the mesh screen covering over a top of the portable backstop;

wherein the rectangular upper frame is inclined so as to be higher in a front and lower in a rear;

wherein a lower left sidebar, a lower right sidebar, a lower front mesh retention crossbar and a lower rear mesh retention crossbar comprise a rectangular lower frame that supports the mesh screen covering over a bottom of the portable backstop;

wherein the rectangular lower frame is inclined so as to be lower in a front and higher in a rear;

wherein the front of the rectangular lower frame touches a ground;

wherein the inclination of the rectangular lower frame causes balls to roll back towards the batter after they are stopped by the portable backstop;

wherein a front left upright, a rear left upright, the lower left sidebar, and the upper left sidebar comprise a left side frame that supports the mesh screen covering on a left side of the portable backstop;

wherein the left side frame is trapezoidal shaped due to the inclinations of the rectangular upper frame and the rectangular lower frame which narrow the portable backstop on the rear side;

wherein a front right upright, a rear right upright, the lower right sidebar, and the upper right sidebar comprise a right side frame that supports the mesh screen covering on a right side of the portable backstop;

wherein the right side frame is trapezoidal shaped due to the inclinations of the rectangular upper frame and the rectangular lower frame which narrow the portable backstop on the rear side;

wherein the front left upright and the front right upright extend below a plane of the rectangular lower frame and both couple to a front lower crossbar via two of the plurality of elbows;

wherein the front lower crossbar rests on the ground;

wherein the rear left upright and the rear right upright extends below the plane of the rectangular lower frame and both couples to a lower rear crossbar via two of the plurality of elbows;

wherein the lower rear crossbar rests on the ground;

wherein the plurality of braces comprise one or more left side braces and one or more right side braces;

wherein the one or more left side braces couple from the lower left sidebar to the rear left upright and to the front left upright to stabilize the left side frame;

wherein the one or more right side braces couple from the lower right sidebar to the rear right upright and to the front right upright to stabilize the right side frame;

wherein the mesh screen covering comprises a rectangular mesh panel, a left mesh wing, and a right mesh wing;

wherein the rectangular mesh panel couples to the lower front mesh retention crossbar by sliding the lower front mesh retention crossbar through a lower crossbar sleeve;

wherein the rectangular mesh panel passes under the lower rear mesh retention crossbar, up and over the upper rear mesh retention crossbar, and couple to the upper front mesh retention crossbar by sliding the upper front mesh retention crossbar into an upper crossbar sleeve.

2. The batting cage according to claim 1 wherein the left mesh wing is a trapezoidal shaped mesh panel that couples to the rectangular mesh panel at a center of a left edge of the rectangular mesh panel;

wherein a shorter parallel edge of the left mesh wing is coupled to a left edge of the rectangular mesh panel;

wherein the right mesh wing is a trapezoidal shaped mesh panel that couples to the rectangular mesh panel at a center of a right edge of the rectangular mesh panel;

wherein the shorter parallel edge of the right mesh wing is coupled to the right edge of the rectangular mesh panel;

wherein the left mesh wing and the right mesh wing are positioned on the rectangular mesh panel such that when the rectangular mesh panel is installed onto the lower front mesh retention crossbar, the lower rear mesh retention crossbar, the upper rear mesh retention crossbar, and the upper front mesh retention crossbar, the left mesh wing and the right mesh wing align with the left side frame and the right side frame formed by the framework, respectively.

3. The batting cage according to claim 2 wherein a plurality of fasteners are distributed on a front edge of the left mesh wing, a front edge of the right mesh wing, the front left upright, and the front right upright;

wherein the plurality of fasteners couple the left mesh wing to the front left upright and couple the right mesh wing to the front right upright.

4. The batting cage according to claim 3 wherein the batting tee comprises a base and the post;

wherein the base is a flat, rectangular mat;

wherein the base comprises a home plate marking on a top surface of the base.

5. The batting cage according to claim 4 wherein the batting tee comprises a plurality of post holes;

wherein each of the plurality of post holes represents a location where the post is placed on the base;

wherein one of the plurality of post holes is located at a center of the base;

wherein the plurality of post holes are located to the left or right of center;

wherein the plurality of post holes are placed in front of the center and behind the center of the base.

6. The batting cage according to claim 5 wherein the base comprises a carrying handle.

7. The batting cage according to claim 6 wherein the post is an adjustable stanchion that holds the ball at a specific height;

wherein the post comprises an upper post, a lower post, a height adjustment, and a ball cup;

wherein the upper post and the lower post are hollow tubes of different diameters;

wherein an outside diameter of the upper post is smaller than an inside diameter of the lower post;

wherein a position of the upper post relative to the lower post is maintained by the height adjustment;

wherein the height adjustment is released to adjust an overall height of the batting tee;

wherein a bottom end of the lower post is a same diameter as the plurality of post holes in the base;

wherein a height of the ball in the ball cup is adjustable by adjusting the height of the post;

wherein the ball cup is a horizontally oriented concave surface that prevents the ball from rolling out of the post until the ball is hit.

8. The batting cage according to claim 7 wherein one or more anchor pins are pushed into the ground to hold the portable backstop in place.

9. The batting cage according to claim 8 wherein the batting cage further comprises a target panel;

wherein the target panel comprises a rectangular fabric panel having a target panel upper sleeve, a target panel lower sleeve, and an aiming point and which is hung at a rear of the portable backstop;

wherein the target panel is positioned within the portable backstop by sliding the upper rear mesh retention crossbar through the target panel upper sleeve and by sliding the lower rear mesh retention crossbar through the target panel lower sleeve during assembly;

wherein the aiming point is a marking on the target panel that represents a destination of a perfectly hit ball.

* * * * *